United States Patent [19]

Hoffmann

[11] Patent Number: 4,688,412

[45] Date of Patent: Aug. 25, 1987

[54] SHAFT STRAIGHTENING MACHINE

[76] Inventor: George T. Hoffmann, 680 Van Voorhis Ave., Rochester, N.Y. 14617

[21] Appl. No.: 836,375

[22] Filed: Mar. 5, 1986

[51] Int. Cl.[4] ..... B21D 3/02; B21F 1/02

[52] U.S. Cl. ..... 72/110; 140/147

[58] Field of Search ..... 72/92, 93, 107, 108, 72/110; 140/147

[56] References Cited

U.S. PATENT DOCUMENTS

| | | | |
|---|---|---|---|
| 3,045,739 | 7/1962 | Fyfe et al. | 72/92 |
| 3,625,263 | 12/1971 | Kopczynski | 72/110 |
| 3,672,411 | 6/1972 | Kopczynski | 72/110 |
| 3,875,978 | 4/1975 | Kopczynski | 140/147 |
| 4,020,665 | 5/1977 | Koizumi et al. | 72/108 |

FOREIGN PATENT DOCUMENTS

| | | | |
|---|---|---|---|
| 795657 | 1/1981 | U.S.S.R. | 140/147 |

*Primary Examiner*—Lowell A. Larson
*Attorney, Agent, or Firm*—Martin Lukacher

[57] ABSTRACT

A machine for straightening shafts which may be extremely crooked has a pair of bending members which may take the form of eccentric rollers mounted on parallel shafts having a common vertical center line, and which engage the shaft to be straightened as it enters between the bending members and deform the shaft in opposite directions, while rolling the shaft, thereby straightening it. Auxiliary rollers are movable into and out of the region between the bending members so as to locate the shaft to be bent between the bending members while they are at their greatest separation. These auxiliary rollers are capable of bending the shaft to be straightened so as to fit between the bending members. The auxiliary rollers remain in their inward position and locate the shaft to be straightened, and prevent it from escaping from between the bending members, until the bending members engage the shaft to be straightened. Then the auxiliary rollers retract and remain retracted until the straightened shaft is ejected from between the bending members.

16 Claims, 6 Drawing Figures

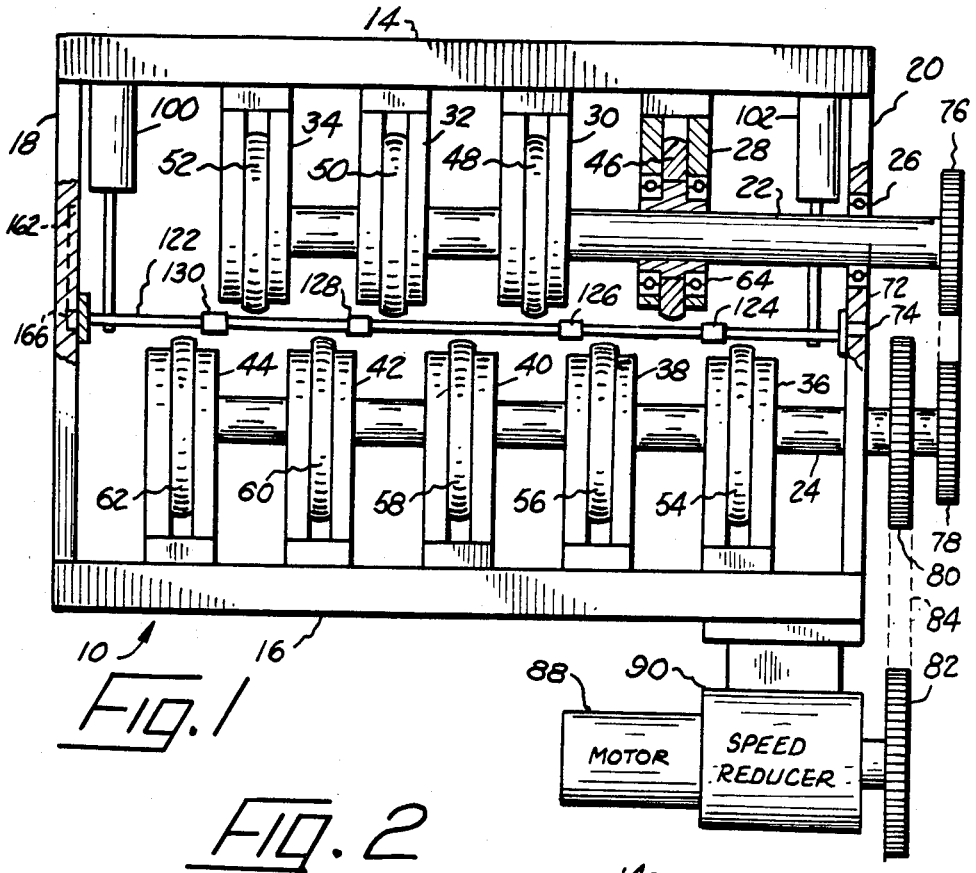
FIG. 1
FIG. 2
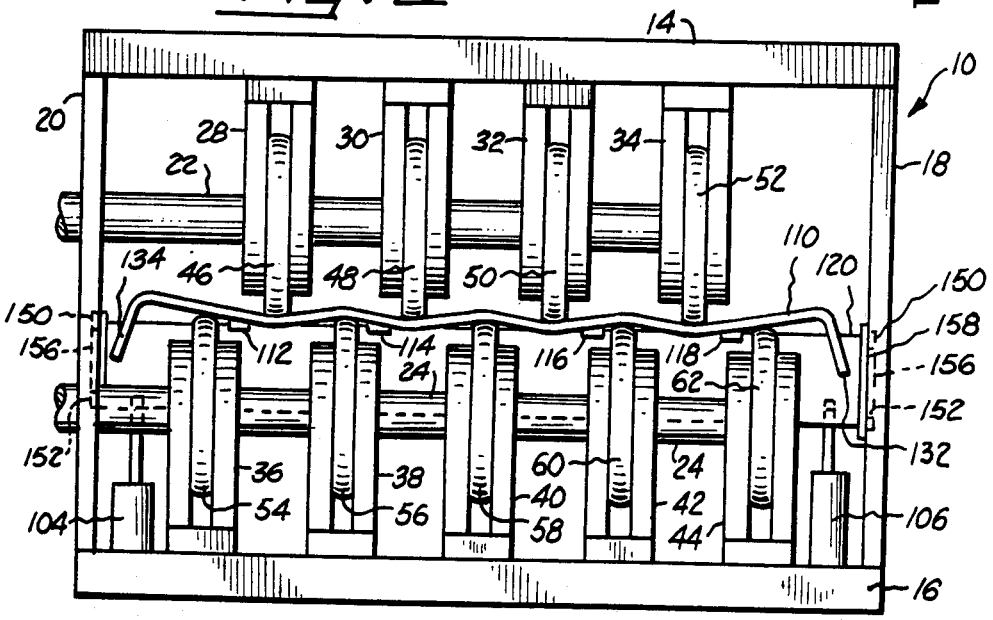

SHAFT STRAIGHTENING MACHINE

The present invention relates to shaft straightening machines, and particular to machines which straighten bent shafts by variably deforming, while rolling, the shafts.

The invention is especially suitable for use with shafts which are extremely distorted and crooked, for example shafts which become distorted during heat treatment. The invention is also especially suitable for straightening shafts for having offset ends which must pass through the straightening machine without being deformed.

It is a feature of the invention to provide an improved centerless shaft straightening machine wherein bending members which deform the shaft need not be mounted on centers of rotation which interfere with the workpiece shaft to be straightened.

It is a further feature of the invention to provide an improved shaft straightening machine which is capable of deforming and straightening extremely bent shafts, which may not fit in the clearance between the bending members which straighten the shaft and tend to be ejected before engagement by the bending members.

Various types of shaft straightening machines which overbend shafts while rotating the shafts have been proposed. U.S. Pat. No. 4,488,423 issued Dec. 18, 1984 utilizes opposed jaws which reciprocate in opposite directions, while sliding the part to be straightened between the jaws. Such machines require complex drive and actuating mechanisms and are utilized mainly for small parts. It has also been proposed to insert parts to be straightened between sets of three rollers approximately 120 degrees apart which engage and overbend the parts. (See U.S. Pat. Nos. 1,045,161, issued Nov. 26, 1912 and 1,537,501 issued May 12, 1925). A knurling machine has been proposed using eccentric knurling rolls 120 degrees apart, between which a shaft to be knurled is inserted U.S. Pat. No. 2,285,688, issued June 9, 1942).

With straightening machines utilizing rollers, it is difficult to straighten extremely bent shafts, since the clearance between the rollers at their entry position most accommodate the diameter of the shaft where it is extremely out of round. Otherwise the bent work piece may be rejected and never get between the members which deform the work piece in order to straighten it. Therefore three sets of bending rolls have been used, at least one which is movable and can be separated to allow the loading of the bent work piece. The movable set of rolls is held with great force against the other sets of bending rolls, thereby complicating the design due to the need to provide for a movable set of bending rolls which must deliver great enough force to the work piece to deform it beyond its elastic limit. Such machines are therefore usually designed to be operable only upon heated shafts (hot working). Hot working may require the work piece to be refinished in order to remove scale and other deterioration which is incident to hot working.

It may also be necessary to straighten shafts which have offsets, such as hooks or other projections, ML-0172 at the ends thereof. Known machines for rolling bent shafts have sets of bending rollers which must be supported on centers or are otherwise restrained in supports or standards which do not enable the offsets at the ends of the shafts to pass through the straightening machine without hinderance. In other words it is desirable to provide a centerless straightening machine which can handle shafts having projections, hooks and other offsets at the ends thereof.

Another drawback of existing straightening machines is their complexity. They require special articulated tables and jaws or multiple sets of bending rollers.

The present invention makes it possible to bend extremely crooked shafts in a centerless bending mode of operation which needs only a pair of side by side bending members. These bending members may be eccentric rollers or cams mounted on shafts which may be driven with high torque, as from a high horse power electric motor. The rollers on each shaft and the shafts themselves may be supported in separate bearings so as to enable the use of large enough rollers to provide centerless operation with clearance for offsets or other devices mounted at the ends of the shafts to be straightened. The eccentricity of the bending rollers is such that they overlap at their closest separation sufficiently to overbend the shafts to be straightened beyond their elastic limit while the shafts are cold (cold working). The region between the rollers varies in length as the separation of the adjacent surfaces changes from overlapping to a spacing which provides clearance between the rollers. The shafts are loaded ML-0172 when the bending rollers have rotated to the position of their furthest separation. The shafts are engaged by reciprocating auxiliary rollers which move toward and away from each other on opposite sides of the region between the bending rollers. Preferably, the auxiliary rollers are reciprocally mounted to pivot above and below the region between the bending rollers. The reciprocation of the auxiliary rollers is timed with the rotation of the bending rollers so that they move toward each other and capture the shaft to be straightened when the bending rollers are at their furthest separation. The auxiliary rollers are actuated with sufficient force to not only locate, but also to bend the shaft to be straightened sufficiently to enable the shaft to fit between the bending rollers, when the bending rollers are at their greatest separation. The pivoting auxiliary rollers may be actuated with a toggle linkage so as to multiply the force which is applied by the auxiliary rollers to the shaft to be straightened. The force applied need only be sufficient to bend the shaft without permanent deforming (within the elastic limit of the shaft). The bending rollers rotate continuously and synchronize the reciprocation of the auxiliary rollers so that they release when the bending rollers engage the auxiliary rollers; for example after the bending rollers have rotated approximately 90 degrees from their position of greatest separation. The bending rollers cold work the shaft, deforming it beyond its elastic limit and applying bending forces along opposing surfaces and in opposite directions while rolling the shaft. Such operation straightens the shaft. When the bending rollers return to their position of widest ML-0172 separation, the straightened shaft exits from between the rollers. A fraction of a second later, a new shaft to be straightened enters and is captured (and if necessary bent) between the opposing auxiliary rollers.

Since the bending rollers are mounted on separate shafts along the same center line, their separation can be adjusted so as to accommodate work-piece shafts of varying diameters. Auxiliary devices may be mounted on the bending roller shafts to assist in ejecting the straightened shafts.

The foregoing and other objects, features and advantages of the invention, as well as the presently preferred embodiment thereof, will become more apparent from a reading of the following description in connection with the accompanying drawings in which:

FIG. 1 is an elevational, front-view of a shaft straightening machine embodying the invention;

FIG. 2 is an elevational, rear-view of the machine shown in FIG. 1;

Figure 3:
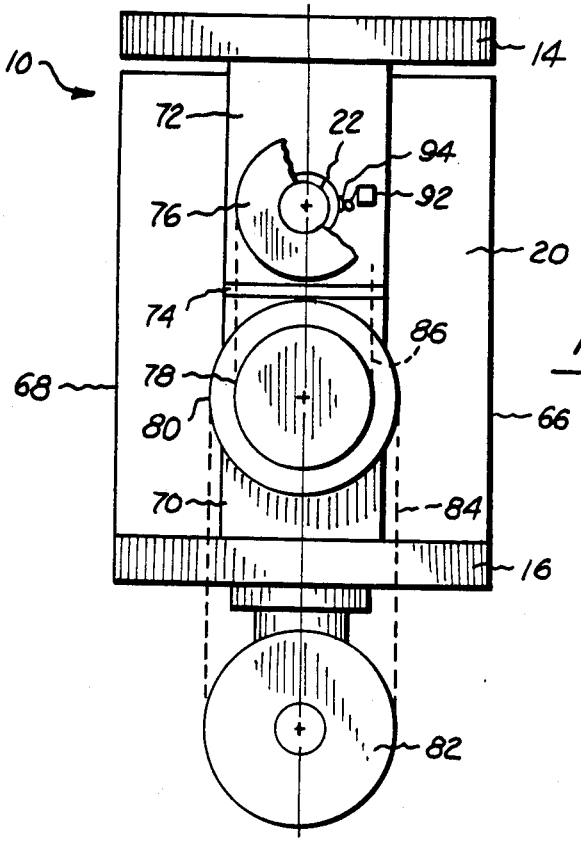
FIG. 3 is an elevational end-view of the machine shown in FIGS. 1 & 2.
Figure 4:
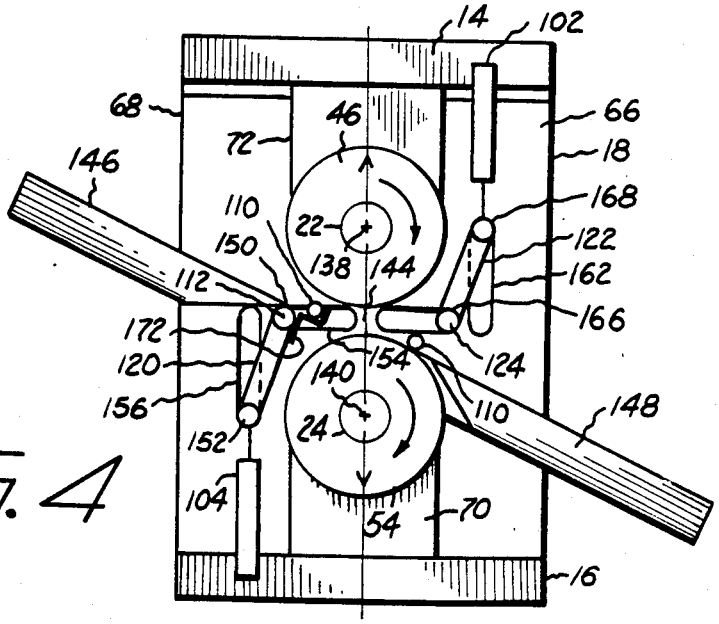
Figure 5:
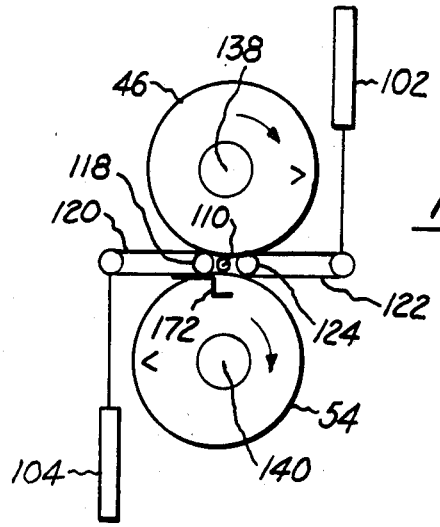
Figure 6:
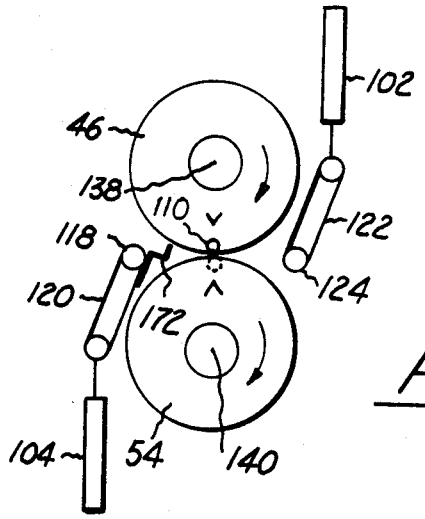

FIGS. 4, 5, & 6 are diagrammatic views illustrating the position of the bending rolls and auxiliary rolls in different parts of the cycle of operation of the machine shown in FIGS. 1, 2, & 3.

Referring to FIG. 1 of the drawings, the presently preferred embodiment of the shaft straightening is shown from the front with the loading mechanism, which is mounted on the front, removed. The framework 10 of the machine is a box-like assembly of top and bottom plates 14 and 16 and side plate assemblies 18 and 20. Upper and lower drive shafts 22 ML-0172 and 24 are mounted in a centerless configuration in bearings in one of the side plate assemblies 20 and in a plurality of pillow blocks or supports 28, 30, 32 and 34 for the upper drive shaft 22 and another plurality of pillow blocks or supports 36, 38, 40, 42 and 44 for the lower drive shaft 24. Bearings 26 in the side plate assembly 20, which rotatably mount the upper drive shaft 22, are shown in FIG. 1. It will be appreciated that another bearing similar to the bearing 26 is provided in the side plate assembly 20 for the lower drive shaft 24.

Each of the drive shafts has mounted thereon, and rotatable therewith, a plurality of bending members, which in this preferred embodiment of the invention are eccentric bending cams or rollers. Four of these rollers 46, 48, 50 and 52 are mounted on the upper drive shaft 22. Five of these eccentric rollers 54, 56, 58, 60 and 62 are mounted on and rotatable with the lower drive shaft 24. Bearings 64 in the pillow block 28 rotatably support the upper shaft 22 and the bending roller 46 in the upper drive shaft 22. The bending roller 46 is keyed to the drive shaft 22 so as to rotate therewith. Similar bearings are provided for each of the other rollers 48 through 62, in their respective pillow blocks 30 to 44.

As shown in FIG. 1 and FIG. 3, the side plate assembly 20 has side bars 66 and 68 which are assembled to the base plate 16 of the framework 10 and define a U-shaped guide structure in which there is disposed an intermediate lower plate 70 and an intermediate upper plate 72. It will be appreciated that the other side plate assembly 18 has a similar arrangement of side bars ML-0172 and intermediate plates. The upper intermediate plate 72 is part of an assembly including the shaft 22, the top plate 14 of the framework 10 and the pillow blocks 28 to 34 and bending rollers 46 to 52. By sliding the assembly including the intermediate plates 72 up and down between the side bars 66 and 68 the separation between the upper set of bending rollers 46 to 52 and the lower set of bending rollers 54 to 62 may be adjusted. The adjustment leaves a gap 74 which may be filled with a shim to set the adjustment. Such adjustment enables different diameter shafts to be straightened, using the shaft straightening machine provided by this embodiment of the invention.

The upper and lower shafts 22 and 24 and the bending rollers 46 to 62, which rotate therewith, are driven by sprockets 76, 78, 80 and 82. A chain 84 is entrained around the sprockets 80 and 82. The sprockets 76 and 78 are coupled together and rotate with each other and another chain 86. An electric motor 88, of sufficient horse power to develop sufficient torque to cause the shaft to be straightened to be deformed, is mounted on a speed reducer 90 (suitably a conventional gear train) which is attached to the base plate 16. Since the shafts 22 and 24 are coupled together by the chains and sprockets they, and their bending rollers 46 to 62, are driven in synchronism. Timing for operating loading mechanisms (the auxiliary loading and bending members referred to above and described in detail hereinafter) is obtained by a switch 92 actuated by a trip dog 94 attached to the shaft 22. This provides for synchronous operation of the auxiliary members with the rotation of the bending members. The switch 92 may be ML-0172 conventional pneumatic control switch for pneumatic cylinders 100 and 102 on the outlet side of the machine, and pneumatic cylinders 104 and 106 on the inlet side of the machine (see FIG. 2).

Referring to FIGS. 1, 2 and 4, auxiliary members for locating, and if necessary pre-bending the work-piece shafts 110 are provided by two sets of rollers 112 to 118 and 124 to 130. The set of rollers 112, 114, 116 and 118 are rotatably mounted along an inside edge of a pivotal support member 120. The support member 120 is on the inlet side of the machine and is shown in FIG. 2 and in FIG. 4 in the same position.

Another pivotal support member 122 has rotatably mounted along its inside edge the other set of locating and pre-bending rollers 124, 126, 128 and 130. The support member 122 and its auxiliary rollers 124 through 130 are shown in a position corresponding to their locating and pre-bending position as shown in FIG. 5 and FIG. 1. In other words, FIGS. 1 and 2 show the shaft straightening machine during different parts of its cycle of operation; FIG. 1 showing the machine where the upper set of bending rollers 46 to 52 are at their furthest separation from the lower set of bending rollers 54 to 62, and FIG. 2 showing the upper set of bending rollers 46 to 52 overlapping, and in their position of closer separation, to the lower set of bending rollers 54 to 62. It will be observed that the work-piece shaft 110 is being overbent and deformed when the upper and lower sets of bending rollers are in overlapping relationship. ML-0172

FIG. 2 also shows the advantage of the centerless support for the bending rollers. The work-piece shaft 110 has offsets 132 and 134 at the ends thereof. Because of the centerless mounting of the shafts 22 and 24 and the bending rollers mounted thereon, the offsets 132 and 134 find sufficient clearance in the machine to pass through the machine. Thus, shafts having offset ends can be handled and straightened with the shaft straightening machine provided by the invention.

The auxiliary members (the locating and pre-bending rollers 112 to 118 and 124 to 130) are disposed between the adjacent bending rollers of the upper and lower sets of bending rollers which are adjacent to each other. For example, the auxiliary roller 112 is axially spaced between the axially offset bending rollers 46 and 54 of the upper and lower sets of bending rollers respectively. The upper set of bending rollers are spaced axially along their drive shaft 22, the lower set of bending rollers are also spaced axially along their drive shaft 24. The bending rollers are offset so that successive rollers are disposed alternately along different ones of the axes of the upper and lower drive shafts 22 and 24. It will be rack 148 and the fresh shaft 110 is ready to be loaded into the region 144. This fresh shaft is captured and pre-bent if necessary between the opposing sets of auxiliary rollers. Only when the bending rollers engage the shaft 110 are the auxiliary rollers moved to their retracted position, ready for the next shaft.

From the foregoing description it will be apparent that there has been provided an improved straightening machine. A presently preferred embodiment of a machine in accordance with the invention has been described. Variations of and modifications to the herein described shaft straightening machine, within the scope of the invention, will undoubtedly suggest themselves to those skilled in the art. Accordingly, the foregoing description should be taken as illustrative and not in a limiting sense.

I claim:

1. A shaft straightening machine comprising a plurality of eccentrically rotatable shaft bending members disposed along two opposed and parallel axes of rotation for receiving and engaging the shaft to be straightened therebetween, successive ones of said bending members being disposed alternately along different ones of said two axes, means for rotating said plurality of bending members about their respective axes, said bending members defining a region therebetween wherein said shaft is received, said bending members defining in said region as they rotate a separation therebetween which varies in distance from a smallest distance less than the diameter of said shaft to a greatest distance at least equal to the diameter of said shaft, a plurality of auxiliary members which are disposed on opposite sides of said region, means for reciprocating said auxiliary members toward and away from each other in timed relationship with the rotation of said bending members for capturing said shaft in said region between said bending members when said bending members rotate to the position of their greatest separation and retain said shaft between said bending members at least until said bending members rotate into engagement with said shaft.

2. The machine in accordance with claim 1 wherein said auxiliary members are disposed in a position where they are separated by a distance less than a diameter of said shaft when reciprocated toward each other for pre-bending said shaft to fit between said bending members when said bending members are separated at their said greatest distance.

3. The machine according to claim 1 wherein said rotating means are operable for rotating said bending members in the same direction.

4. The machine according to claim 1 wherein said means for reciprocating said auxiliary members toward and away from each other include means for maintaining said auxiliary members toward each other while said bending members rotate in a direction from their position of asid greatest separation distance to their position of said smallest separation distance over an arc sufficient for said bending members to engage said shaft.

5. The machine according to claim 4 wherein said arc is approximately 90 degrees.

6. The machine according to claim 4 wherein said auxiliary members are rollers, said reciprocating means comprising a first pivotable member carrying a first group of said plurality of rollers thereon, a second pivotable member carrying a second group of said plurality of rollers thereon, said pivotable members extending along the axes of rotation of said bending members on opposite sides of said region, and actuating means for pivoting said first and second pivotable members in timed relationship with the rotation of said bending members.

7. The machine according to claim 6 wherein said first and second pivotable members are pivotable from above and from below said region in which said shaft is located between said bending members, and said actuating means includes means for pivoting said first and second pivotable members in clockwise and counterwise directions.

8. The machine according to claim 1 wherein said bending members are bending rollers, a first shaft, a second shaft, said first and second shafts having axes of rotation parallel to and spaced from each other, means for rotating said shafts together with each other, a first group of said bending rollers being eccentrically mounted on and rotatable with said first shaft, a second group of said bending rollers being eccentrically mounted on and rotatable with said second shaft in 180 degrees out of phase relationship to define in said region said largest separation distance and said smallest separation distance successively upon 180 degrees of rotation of said first and second shafts, and said auxiliary members being movable transversely to a plane between the axes of said first and second shafts to positions on opposite sides of said plane toward and away from the midpoint between the axes of said first and second shafts.

9. The machine according to claim 8 wherein said first shaft is disposed vertically above said second shaft, first and second support members for said auxiliary members pivotably mounted on axes parallel to the axes of said first and second shafts, said first and second support members being movable from above and below said mid-point, respectively, said support members being disposed on opposite sides of said region wherein said shaft to be straightened is received, and said auxiliary members being movable in opposition to each other with said support members to locate said shaft to be straightened in said region between said bending rollers.

10. The machine according to claim 9 further comprising an inlet feed rack for delivering shafts to be straightened sequentially into said region, and an outlet rack for receiving straightened shafts from said bending members, said racks being disposed on opposite sides of said region, said inlet rack being inclined downwardly toward said region, and said outlet rack being inclined downwardly away from said region.

11. The machine according to claim 1 further comprising first and second shafts having parallel axes of rotation, means for rotating said first and second shafts in synchronism with each other, a first group of said plurality of bending members being rollers connected to and rotatable with said first shaft, a second group of said plurality of bending members being rollers connected to and rotatable of which said second shaft, each of said first group of rollers being spaced axially from each other along said first shaft, each of said second group of rollers being spaced axially from each other along said second shaft and between adjacent rollers of said first group, said rollers defining said region there between for receiving said shaft to be straightened, said region extending axially of said first and second shafts along a plane between the axes of said first and second shafts.

12. The machine according to claim 11 wherein the axes of said first and second shafts are in the same vertical plane.

seen, especially from FIGS. 4 to 6, that the axes of the bending rollers (also the axes 138 and 140 of their co-axial drive shafts 22 and 24) are parallel to each other and are disposed in the same vertical plane 142.

The region 144 between the upper and lower sets of bending rollers receives the work-piece shafts 110. These shafts are delivered by inlet and outlet racks 146 and 148. The rack 146 is inclined downwardly toward the ML-0172 region 144. A mechanism (not shown), which may be pneumatically operated in synchronism with the rotation of the drive shafts 22 and 24, may be provided on the inlet rack 146 for successively delivering shafts 110 to be straightened into the region 144. The outlet rack 148 is inclined downwardly away from the region so as to enable the straightened shafts to be delivered by gravity to a receiving bin below the outlet rack 148.

The set 112 to 118 of auxiliary rollers is mounted for pivotal movement with its support member 120 on rollers 150 and 152 at the opposite ends of the support member 120. These rollers are captured in slots 154 and 156 in the side plates 18 and 20 of the framework 10. The support members 120 may be strengthened by end plates 158 and 160 (see FIG. 2) where their rollers 150 and 152 enter the slots 154 and 156. The pneumatic cylinders 104 and 106 actuate and pivot the support members 120, thereby causing the auxiliary rollers 112 to 118 to reciprocate toward and away from the region 144. The support plate 120 and the slots 154 and 156 provide a toggle linkage which increase the force applied to the auxiliary rollers 112 to 118 as they are moved inwardly toward the region. The center line of the slots 156, and of course the center line of the auxiliary rollers 112 to 118 travels along a line perpendicular to the center line 142 which intersects midpoint between the axes 138 and 140 of the eccentric bending members and their co-axial drive shafts 22 and 24.

The other set of auxiliary rollers 124 to 130 reciprocates in opposition to the set of rollers 112 to 118. These rollers 124 to 130 are disposed in opposed ML-0172 relationships on opposite sides of the vertical plane containing the center line 142 extending between the centers of the upper and lower sets of bending rollers and their shafts 22 and 24. The auxiliary rollers 124 to 130 and their support member 122 are articulated in the same manner as the rollers 112 to 118 and their support member 120. Specifically, vertical and horizontal slots 162 and 164 in the side plates 18 and 20 capture rollers 166 and 168 located at the opposite ends of the support member 122. When the support member 122 is pivoted by the pneumatic cylinders 100 and 102, the support member 122 reciprocates inwardly and pivots downwardly toward the region 144. The toggle articulation multiplies the force applied to the auxiliary rollers 124 to 130. Accordingly, the maximum force applied by both sets of opposing auxiliary rollers occurs when they are at their full inward position where they engage the work-piece shaft 110 in the region 144. It will be seen that a line along the center of the auxiliary rollers 124 and the slot 164 is also perpendicular to the center line 142 at the midpoint between the axes 138 and 140 of the eccentric rollers and their drive shafts 22 and 24.

"Z" shaped catching members 172 are attached to the support member 120 adjacent to and below each of the auxiliary rollers 112 to 118 on the inlet side of the straightening machine. These catching members 172 present fingers bent to form individual troughs which catch the work-piece shafts 110 as they drop off the inlet rack 146, and deliver these shafts into the region 144. When the auxiliary rollers 112 to 118 of the inlet set of auxiliary rollers and the outlet set of ML-0172 auxiliary rollers 124 to 130 are in their inward position, the catching members 172 are out of the way, as shown in FIG. 5.

The operation of the shaft straightening machine will be apparent from FIGS. 4, 5, and 6. The eccentric bending rollers or cams are rotated synchronously in the same direction. They are spaced so that they have their greater separation when 180 degrees out of phase as shown in FIG. 4. Then, the region 144 provides the largest clearance for the shafts 110 to be straightened. The auxiliary rollers and their support member are actuated in synchronism with each other so as to capture and engage the work-piece shaft on opposite sides thereof. The timing from the drive shaft 22 through the switch 92 (see FIG. 3) assure the synchronous actuation of the auxiliary rollers. At this point in the cycle, the pivotal auxiliary rollers have reciprocated to the position shown in FIG. 4 where they are furthest apart and allow a shaft which has been straightened to drop out of the region 144 and on to the outlet rack 148. The next shaft is located in the trough of the catching members 172.

As the bending rollers continue their rotation, the pneumatic cylinders 104,106 are actuated to reciprocate the auxiliary rollers inwardly, thereby delivering the next work-piece shaft 110 into the region. In the event that the shaft is bent and distorted so badly that it cannot fit within the region, it is pre-bent by the opposing sets of auxiliary rollers 112 to 118 and 124 to 130 so as to fit within the region 144. This bending need not be beyond the elastic limit of the material of the work-piece shaft 110. Therefore sufficient ML-0172 pre-bending force can readily be applied by the pneumatic cylinders 102 to 106 by way of the toggle linkages provided by the support members 120 and 122, their end rollers 150, 152 and 166, 168 and slots 150, 156 and 162, 164.

The separation between the eccentric bending rollers is set by the adjustment mechanism discussed above so that the rollers (46 and 54 as illustrated in FIG. 5) engage the work-piece shaft 110 when they rotate to an arc of 90 degrees from their 180 degree, furthest separation, which is the position shown in FIG. 4. At the 90 degree position as shown in FIG. 5, the auxiliary rollers 118 and 124 are still in engagement and still pre-bending (if necessary) and locating the work-piece shaft 110. The timing of the pneumatic cylinders is such that, when the shaft 110 is engaged by the bending rollers 46 and 54 the auxiliary rollers 118 and 124 are retracted to the position shown in FIG. 6. The bending rollers then overlap and bend and deform the shaft 110. The shaft 110 has its maximum deformation when the separation of the bending rollers is the smallest. At the position where the separation is the smallest, the rollers have rotated 180 degrees from their position when the separation is the largest (from the position shown in FIG. 4 to the position shown in FIG. 6). The work piece rotates in a direction opposite to the direction of the bending rollers. This is the counterclockwise direction, since the bending rollers rotate in the clockwise direction as shown in FIGS. 4 to 6. As the shafts are continuously overbent, while being rolled with increasing and decreasing bending forces, they are straightened.

The auxiliary rollers do not move inwardly until the bending rollers return to the position shown in FIG. 4. Then the straightened shaft is dropping down the outlet 13. The machine according to claim 12 wherein said auxiliary members are a plurality of rollers which are movable towards and away from each other and are disposed in first and second groups on opposite sides of said region.

14. The machine according to claim 13 wherein said first group of rollers is pivotable from below said region toward said region, said second group of rollers ML-0172 being pivotable from above said region toward said region, and means for supporting said rollers and pivoting said rollers in synchronism with the rotation of said shafts.

15. The machine according to claim 11 further comprising a plurality of bearings each on an opposite side of a different one of said bending rollers and each supporting said bending rollers and the one of said of such shaft on which said bending rollers are mounted in centerless relationship.

16. The machine according to claim 13 wherein said first group of auxiliary member rollers are disposed on the inlet side of said bending rollers, and a plurality of catching members offset below and movable with said first group of auxiliary member rollers for carrying said shaft to be straightened into said region. ML-0172

* * * * *